US008618039B2

(12) United States Patent
Srinivasan et al.

(10) Patent No.: US 8,618,039 B2
(45) Date of Patent: Dec. 31, 2013

(54) GRANULAR MATERIALS FOR FINISHING DENIM

(75) Inventors: Ganesh Srinivasan, Bangalore (IN); Anick Colson, Champion (BE); Alice Devinat, Montbellard (FR); Jacqueline L'Hostis, Silly (BE); Padmadas Nair, Maharashtra (IN)

(73) Assignees: Dow Corning India, Mumbai (IN); Dow Corning Corporation, Midland, MI (US)

( * ) Notice: Subject to any disclaimer, the term of this patent is extended or adjusted under 35 U.S.C. 154(b) by 0 days.

(21) Appl. No.: 12/518,835

(22) PCT Filed: Dec. 11, 2007

(86) PCT No.: PCT/EP2007/063726

§ 371 (c)(1),
(2), (4) Date: Feb. 19, 2010

(87) PCT Pub. No.: WO2008/071710

PCT Pub. Date: Jun. 19, 2008

(65) Prior Publication Data

US 2010/0219368 A1 Sep. 2, 2010

(30) Foreign Application Priority Data

Dec. 15, 2006 (GB) ..... 0625046.8

(51) Int. Cl.
*C11D 3/08* (2006.01)
*C11D 9/36* (2006.01)
*C11D 3/37* (2006.01)

(52) U.S. Cl.
USPC ..... 510/287; 510/276; 510/315; 510/323; 510/326; 510/327; 510/343; 510/347; 510/377; 510/398; 510/466; 510/477; 510/507; 510/532

(58) Field of Classification Search
USPC ..... 8/115.51, 181, 558; 510/276, 287, 315, 510/323, 326, 327, 343, 347, 377, 398, 466, 510/477, 507, 532
See application file for complete search history.

(56) References Cited

U.S. PATENT DOCUMENTS

| | | | | |
|---|---|---|---|---|
| 3,655,420 | A | 4/1972 | Tichenor | |
| 5,026,489 | A | 6/1991 | Snow et al. | |
| 5,045,225 | A * | 9/1991 | Aronson et al. | 510/466 |
| 5,117,024 | A | 5/1992 | Dinh et al. | |
| 6,040,288 | A * | 3/2000 | Popoff et al. | 510/466 |
| 6,313,080 | B1 * | 11/2001 | Boskamp et al. | 510/298 |
| 2002/0193276 | A1 * | 12/2002 | Murphy et al. | 510/446 |
| 2004/0102345 | A1 * | 5/2004 | Orchowski et al. | 510/256 |
| 2004/0121938 | A1 * | 6/2004 | Blokzijl et al. | 510/511 |
| 2005/0164900 | A1 * | 7/2005 | Masschelein et al. | 510/392 |
| 2006/0134239 | A1 * | 6/2006 | Weide et al. | 424/745 |
| 2006/0257281 | A1 * | 11/2006 | Weide et al. | 422/6 |
| 2008/0028539 | A1 | 2/2008 | Koch | |

FOREIGN PATENT DOCUMENTS

| | | | |
|---|---|---|---|
| CN | 1289364 | A | 3/2001 |
| DE | 3743325 | A1 | 6/1989 |
| EP | 0013028 | A1 | 7/1980 |
| EP | 0125779 | A2 | 11/1984 |
| EP | 0142910 | A1 | 5/1985 |
| EP | 0206522 | A2 | 12/1986 |
| EP | 0210721 | A2 | 2/1987 |
| EP | 0212787 | A2 | 3/1987 |
| EP | 0298402 | A2 | 1/1988 |
| EP | 0381318 | A2 | 8/1990 |
| EP | 0384070 | A2 | 8/1990 |
| EP | 0484081 | A2 | 5/1992 |
| EP | 0747471 | A1 | 12/1996 |
| EP | 1101857 | A2 | 5/2001 |
| GB | 788984 | A | 1/1958 |
| GB | 882059 | A | 11/1961 |
| GB | 882061 | A | 11/1961 |
| GB | 1023209 | A | 3/1966 |
| GB | 1117043 | A | 6/1968 |
| GB | 1407997 | A | 10/1975 |
| GB | 1429143 | A | 3/1976 |
| GB | 1473201 | A | 5/1977 |
| GB | 1523957 | A | 9/1978 |
| GB | 1554736 | A | 10/1979 |

(Continued)

OTHER PUBLICATIONS

English language abstract for DE3743325 extracted from espacenet.com database, dated Sep. 28, 2009, 9 pages.

(Continued)

*Primary Examiner* — Charles Boyer

(74) *Attorney, Agent, or Firm* — Howard & Howard Attorneys PLLC

(57) ABSTRACT

A granular material for use in the treating of textile materials, comprising (i) a silicone material having at least one nitrogen containing substituent, (ii) an aluminosilicate carrier and (iii) a binder, preferably in conjunction with a surface active material. Also described is a process for preparing such granular materials, which comprises forming a water-in-oil emulsion of component (i) in conjunction with component (iii) by dispersing and agitating said components in water, followed by depositing said emulsion onto a free flowing powder form of component (ii), for example by spraying, and removing sufficient water from the product to obtain a free flowing granular material. The granules are useful in a process of treating textile materials in an aqueous medium, particularly where the textile material is denim. Preferably the granular material is added into the finishing steps of denim such as the desizing, the fading or the softening steps and helps with avoiding backstaining.

13 Claims, No Drawings

(56) References Cited

FOREIGN PATENT DOCUMENTS

| | | | |
|---|---|---|---|
| GB | 2113236 | A | 6/1983 |
| GB | 2119394 | A | 11/1983 |
| GB | 2173510 | A | 1/1986 |
| GB | 2166750 | A | 5/1986 |
| GB | 2175000 | A | 11/1986 |
| GB | 2286205 | A | 8/1995 |
| WO | WO 9535363 | A1 | 12/1995 |
| WO | WO 9820855 | A1 | 5/1998 |
| WO | 9940171 | A1 | 8/1999 |
| WO | WO 02/18528 | A1 | 3/2002 |
| WO | WO 2005056742 | A1 | 6/2005 |
| WO | WO 2005/075622 | A1 | 8/2005 |

OTHER PUBLICATIONS

English language abstract for EP 0013028 extracted from espacenet.com database, dated Sep. 28, 2009, 24 pages.

English language equivalent for WO2005056742 extracted from espacenet.com database, dated Sep. 29, 2009, 27 pages.

PCT International Search Report for PCT/EP2007/063726, dated Apr. 8, 2008, 3 pages.

* cited by examiner

GRANULAR MATERIALS FOR FINISHING DENIM

RELATED APPLICATIONS

This application claims priority to and all the advantages of International Patent Application No. PCT/EP2007/063726, filed on Dec. 11, 2007, which claims priority to Great Britain Patent Application No. GB0625046.8, filed on Dec. 15, 2006.

The present invention relates to granular materials for the treatment of textiles, to a process for making such granular materials and to a process of treating textiles with said granular materials. The invention is particularly related to granular materials which comprise silicone materials having N-containing substituents, an aluminosilicate carrier and a binder material. It also particularly relates to a process for the treatment of textile using said granular materials in order to protect to the textile against back staining from dyes or colorants, in particular in the treatment of denim materials.

It has been known to treat textile materials in their manufacturing with silicone materials having N-containing substituents, which are used on the whole to provide some aspect of softening to the textile. The U.S. Pat. No. 3,655,420 for example broadly provides a process for treating synthetic organic textile fibres with a finishing composition that is (1) a mixture of a polyepoxide and an aminosiloxane, (2) a mixture of an epoxysiloxane and a polyamine, or (3) a mixture of an epoxysiloxane and an aminosiloxane. The products of that process are stated to possess a durable, soft, lubricated feel.

Aluminosilicates are also in themselves known in applications relating to textile treatment. Often they are used in detergent formulations, but they are not known for use in the process of manufacturing textiles. In German patent specification DE3743325 a discontinuous bath dyeing process is described for natural or regenerated cellulose fibre textiles, which is carried out by slop padding with baths containing reactive dyestuffs in an aqueous medium which also contains aqueous NaOH solution and a salt, followed by fixing by a cold dwell in a damp state. The dye bath is stated as also containing finely-divided, practically water-insoluble precipitated $SiO_2$ and/or Na aluminosilicates, but their use is suggested as acting as a buffer, increasing the bath stability, without the drawbacks associated with the use of water glass, e.g. waste liquor pollution, blocking of pipe work, deposits on rollers and embrittlement of the material. Their presence is hence not related to treating textiles.

Often textile treatment is done with ingredients which are provided in a liquid form. In certain climates, however, liquid forms tend to be unstable, and the provision of a more solid material which can be easily dispersed during the treatment process in the appropriate medium would provide tremendous benefits, especially during transportation and storage prior to the treatment process.

'Backstaining' is a term normally associated with denim washing. The denim garment's appeal is said to be in its pre-washed, faded appearance and a soft hand-feel. To give a washed-down effect and worn look, denim garments/fabrics are first desized, followed by treatment with fading enzymes. During these two steps, but especially in the latter, the indigo dyes bleed from the denim warp yarns, and then tend to resettle on the garment or fabric. This is the phenomenon called 'backstaining'. It interferes with the aim of achieving a desired colour contrast after the denim washing, and hence it is essential to find a solution to reduce the backstaining. Backstaining during textile manufacture or treatment is thus a known problem. The production of "aged" denim garments, for example, is normally obtained by non-homogeneous removal of indigo dye trapped inside the fibres by the cooperative action of cellulase enzymes and mechanical factors such as beating and friction. However, when cellulases are present the removed indigo backstains often onto the reverse side of the fabric, which is undesirable. It is also known that conventional anti-dye transfer polymers, although effective for many dyes, are not effective in preventing the backstaining of indigo dyes due to the extreme hydrophobicity of indigo dyes.

In EP 1101857 certain polymers are described which are especially useful in preventing the backstaining of denim during a stonewashing process. These are described as useful in textile manufacturing or treating process by treating a textile with a solution or dispersion of certain hydrophobically modified polymer having a hydrophilic backbone and at least one hydrophobic moiety.

GB2286205 describes a finishing agent for treatment of textile fibre materials of natural origin and/or of regenerated cellulose and/or of synthetic fibres comprises i) 10-90 weight % of a fine-grained, inorganic abrasive, ii) 5-50 weight % of an anionic or non-ionic, low-foaming wetting agent, and iii) 5-50 weight % of a carrier. The carrier can e.g. be a thickening agent containing polyvinyl alcohol, alginate, carboxymethylcellulose or a non-ionic softener, preferably the carrier is a non-ionic softener. Use of this finishing agent provides special surface effects. By varying the relative proportions of the finishing agent's components, the stages of the process and the conditions of the process, e.g. time, temperature, concentrations, and/or the apparatus employed, as well as the after-treatment, various effects are obtained on the textile fibre material through changes of the surface, e.g. opalescence, silk aspect, "vagabond", "snow wash", "distress look", "blanchissure", "peach skin", "angel skin" and "dinosaur skin" effects, or the material appears to be faded, worn, aged, fluffed up, velvety or rubbery. However, no indication is given about these materials being effective in the reduction of backstaining.

WO 02/18528 describes a fabric care composition for domestic laundry comprising (I) a cationic silicone polymer comprising one or more polysiloxane units and one or more quaternary nitrogen moieties an (II) one or more laundry adjunct agent.

Often textile treatment is done with ingredients which are provided in the liquid form. In certain climates liquid forms tend to be unstable, and the provision of a more solid material which can be easily dispersed during the treatment process in the appropriate medium would provide tremendous benefits, especially during transportation and storage prior to the treatment process. However, the ease of incorporating such granular materials into a mainly aqueous process does not always work without difficulties, especially in more complex textile treating processes, such as the process for treating denim.

It has now been unexpectedly found that granular materials which combine silicone materials having at least one nitrogen containing substituent with aluminosilicate carriers and a binder are effective in the treatment of textile materials especially where it is intended to protect the textile materials against excessive backstaining.

Accordingly the invention provides in a first aspect a granular material for use in the treating of textile materials, comprising (i) a silicone material having at least one nitrogen containing substituent, (ii) an aluminosilicate carrier and (iii) a binder. Preferably, the granular material comprises at least 40%, more preferably at least 50% by weight of component (ii). It is preferred that the granular material comprises from 5 to 25% by weight of component (i), from 40 to 90% by weight of component (ii) and from 5 to 40% by weight of component (iii).

Granular materials according to the invention comprise a silicone material having at least one nitrogen containing substituent. Although silicone materials may be silanes, preferably the silicone material is a siloxane polymer having units of the general formula RaSiO4-a/2, wherein each R is independently selected from hydrocarbon groups having from 1 to 12 carbon atoms, preferably alkyl, alkenyl, alkynyl, aryl, alkaryl or aralkyl and a has a value of from 0 to 3, and units of the general formula RbR'SiO3-b/2, where R is as defined above, R' is a nitrogen containing group and b has a value of from 0 to 2. Preferably R is an alkyl group having from 1 to 6 carbon atoms or an aryl or substituted aryl group having from 6 to 8 carbon atoms, such as methyl, ethyl, propyl, isopropyl, butyl, isobutyl, hexyl, cyclohexyl, phenyl, tolyl, and xylyl. Preferably the nitrogen in R' is part of an amino functionality, amido functionality, imide functionality or quaternary ammonium functionality and most preferably amino or amido functionality. These are well known and have been described in many patent applications.

Suitable silicone materials include polyorganosiloxanes of the unit general formula $R_nSiO_{4-n/2}$ wherein n has an average value of from 1.9 to 2.1 and R represents an organic radical attached to silicon through a silicon to carbon bond, from 0.25 to 50 percent of the R substituents being monovalent radicals having less than 30 carbon atoms and containing, in a position at least 3 carbon atoms distance from the silicon atom, at least one —NH— radical and/or at least one —NHX radical, wherein X represents a hydrogen atom, an alkyl radical of 1 to 30 carbon atoms or an aryl radical, the remaining R substituents being monovalent hydrocarbon radicals, halogenated hydrocarbon radicals, carboxyalkyl radicals or cyanoalkyl radicals of 1 to 30 carbon atoms, at least 70 percent of these remaining R substituents being monovalent hydrocarbon radicals of from 1 to 18 inclusive carbon atoms. In the polyorganosiloxanes at least 0.25 percent and up to 50 percent of the total R substituents may consist of the specified amino containing monovalent radicals. The preferred polyorganosiloxanes are, however, those in which the amino-containing substituents comprise from 1 to 5 percent of the total R substituents.

Preferably also the alkyl and aryl radicals represented by X are those having less than 19 carbon atoms and are e.g. methyl, ethyl, propyl, butyl, nonyl, tetradecyl and octadecyl, aryl radicals e.g. phenyl and naphtyl aralkyl radicals e.g. benzyl and beta-phenylethyl, alkaryl, e.g. ethylphenyl and alkenyl e.g. vinyl and allyl. A proportion of the remaining R substituents may be other than monovalent hydrocarbon radicals, for example hydrogen atoms, halogenated hydrocarbon radicals, e.g. chlorophenyl and other substituted hydrocarbon radicals, e.g. carboxyalkyl and cyanoalkyl. However, preferably substantially all of the remaining R substituents are methyl radicals. The amino-containing substituents may contain up to 30, preferably from 3 to 11, carbon atoms. The nitrogen atom of any amino radical in R is linked to the silicon atom through a chain of at least 3 carbon atoms.

Examples of the operative amino-containing substituents are the $—(CH_2)_3NH_2$, $—(CH_2)_3NHCH_2CH_2NH_2$, $—CH_2CH.CH_3.CH_2NHCH_2CH_2NH_2$ and $—(CH_2)_3NH(CH_2)_6NH.CH_3$ radicals. Also operative are polyalkyleneimine radicals, e.g. those of the general formula $R''_2NCH_2CH_2(NHCH_2CH_2)_xNH_3R'$— where R" is a hydrogen atom, an alkyl radical or an aryl radical, x has a value from 1 to 10 inclusive, y is 1 or 2 and R' is a saturated divalent or trivalent hydrocarbon radical having at least 3 carbon atoms.

The preferred polyorganosiloxanes therefore include copolymers of dimethylsiloxane units with delta-aminobutyl(methyl)siloxane units or gamma-aminopropyl(methyl)siloxane units, copolymers of dimethylsiloxane units with methyl(N-beta-aminoethyl-gamma-aminopropyl) siloxane units and copolymers of dimethylsiloxane units with methyl(N-beta-aminoethyl-gamma-aminoisobutyl) siloxane units. If desired the copolymers may be end-stopped with suitable chain terminating units, for example trimethylsiloxane units, dimethylphenylsiloxane units or dimethylvinylsiloxane units. Also if desired at least some of the amino-containing substituents may be present in the chain terminating units.

Suitable are also polydiorganosiloxanes which may be linear (unbranched) or substantially linear siloxane polymers having at least one silicon-bonded $—R^*X$ group in the molecule. The group R* is a divalent moiety, such as alkylene, alkenylene, arylene, or substituted alkylene, alkenylene or arylene, X may be NQC(O)R' wherein Q represents hydrogen, alkyl, alkenyl, aryl or substituted alkyl, alkenyl or aryl, R' represents e.g. H, methyl, ethyl, propyl, octyl, stearyl, vinyl or phenyl, or may be $—C(O)NR''_2$ wherein R" represents e.g. hydrogen, methyl, ethyl, butyl, octyl, dodecyl, octadecyl or phenyl, or may be the group $—[NZ(CH_2)_n]_p NZ(CH_2)_nNZQ$, wherein Z represents hydrogen or R'C(O)—, n is an integer of from 2 to 6 and p is 0, 1 or 2. Examples of X groups therefore are $NH.C(O)CH_3$; $—NHC(O)C_4H_9$; $—NH.C(O)C_8H_{17}$; $—C(O)NH_2$; $—C(O)NH(C_4H_9)$; $—C(O)NH(C_{18}H_{37})$; $—C(O)N(C_2H_5)_2$; $—NC(O)CH_3(CH_2)_2NHC(O)CH_3$; $—NH(CH_2)_2NHC(O)CH_3$; $—NC(O)CH_3N(CH_2)_6NC(O)C_2H_5$; $—NH(CH_2)_2NHC(O)C_{17}H_{35}$; $—NH(CH_2)_4MC(O)C_6H=$ and $—NH(CH_2)_2NC(O)CH_3.(CH_2)_2NHC(O)CH_3$. At least 50 percent of the silicon-bonded substituents in the polydiorganosiloxane may be methyl groups, any substituents present in addition to the —RX groups and the methyl groups being monovalent hydrocarbon groups having from 2 to 20 carbon atoms or the groups $—RNH_2$, —RCOOH and $—R[NH(CH_2)_n]_pNH(CH_2)_nNH_2$. The exemplified polydiorganosiloxane may comprise 1% RX groups of the total number of substituents in the polydiorganosiloxane. The polydiorganosiloxanes are preferably terminated with triorganosiloxy, e.g. trimethylsiloxy, groups but may be terminated with groups such as hydroxy or alkoxy. Although the polydiorganosiloxanes are preferably those consisting of diorganosiloxane units, with or without triorganosiloxane units, they may contain small proportions of chain-branching units, that is mono-organosiloxy units, and $SiO_2$ units. The molecular size of the suitable polydiorganosiloxanes is not critical and they may vary from freely flowing liquids to gummy solids. The preferred polydiorganosiloxanes are, however, those having a viscosity in the range from about $5.10^{-5}$ to about $5.10^{-2}$ $m^2/s$ at 20° C. Such polydiorganosiloxanes are more easily emulsified than the higher viscosity materials. Suitable preparative methods are known in the art and are described for example in U.K. Patent Specifications Nos. 882 059, 882 061, 788 984 and 1 117 043.

Suitable aminosilanes have the general formula $R'_zSi(OR)_{4-z}$ where R can be an alkyl group such as methyl, ethyl, n-propyl, isopropyl, and t-butyl or an aromatic group such as phenyl, tolyl, and xylyl, but is preferably methyl. R' is an amine-containing group, and z is an integer with a value of 1 to 3, preferably 1 or 2. R' has the general formula $—R^8R^7$, wherein each $R^7$ is independently selected from the group consisting of a hydrogen atom and a group of the formula $—R^8NH_2$, and each $R^8$ is independently a divalent hydrocarbon group. Typically, R' is an aminoalkyl group, such as $—(CH_2)_wNH_2$ or $—(CH_2)_wNH—(CH_2)_wNH_2$, wherein w is an integer, preferably with a value of 2 to 4. Examples of suitable aminosilanes include aminoethylaminoisobutylmethyldimethoxysilane, (ethylenediaminepropyl)-trimethoxysilane, and gammaminopropyltriethoxysilane. Aminosilanes are known in the art and are commercially available. U.S. Pat. No. 5,117,024, discloses aminosilanes and methods for their preparation.

Suitable silicone quaternary ammonium compounds are disclosed by U.S. Pat. No. 5,026,489 entitled, "Softening Compositions Including Alkanolamino Functional Siloxanes." The patent discloses monoquaternary ammonium functional derivatives of alkanolamino polydimethylsiloxanes. The derivatives are exemplified by $(R^9{}_3SiO)_2Si\ R^9$—$(CHR^{10})_aNR^{10}{}_bR^{11}{}_{3-b}$ wherein $R^9$ is an alkyl group, $R^{10}$ is H, alkyl, or aryl, $R^{11}$ is $(CHR^{10})OH$, a is 1 to 10, and b is 1 to 3. Preferably, no diquaternary ammonium compound is present in the granular material of the present invention.

The silicone material (i) may also comprise other units such as $R_bR''SiO_{3-b/2}$, where R" may be an (poly)oxyalkylene containing group, an epoxy group, a carboxyl group.

The silicone materials may be linear siloxane materials, with the units containing R' groups pendant of terminal to the siloxane polymer or a combination of both. Alternatively the silicone materials (i) may have some trifunctional or tetrafunctional siloxane units in them (i.e. those where the value of a would be 0 or 1 and where b would be 0), causing some branching in the siloxane material. It would be even possible to include a reasonably large amount of such siloxane units and end up with a siloxane polymer having a three-dimensional network with a fair amount of cross-linking in it. Such siloxane materials would be silsesquioxane or elastomeric silicone materials.

The aluminosilicate carrier material (ii) for use in the granular materials according to the invention may be crystalline or amorphous or a mixture thereof, and has the general formula [1] 0.8-1.5 $Na_2O.Al_2O_3$.0.8-6 $SiO_2$. These materials usually contain some bound water. The preferred aluminosilicates carrier materials contain 1.5-3.5 $SiO_2$ units per unit of $Al_2O_3$ (see formula [1] above) and have an average particle size of not more than about 100 microns, preferably not more than about 20 microns. Both amorphous and crystalline aluminosilicates can be made readily by reaction between sodium silicate and sodium aluminate, as has been described in the literature. Crystalline aluminosilicates (zeolites) are preferred for use in the present invention. Suitable materials are described, far example in British patent specification GB 1 429 143 and GB1 473 201. The more preferred sodium aluminosilicates of this type are the well-known commercially available zeolites A, X, P and mixtures thereof. Especially preferred for use in the present invention is type 4A zeolite and type HA zeolite.

The aluminosilicate carrier material for use in the granular materials according to the invention may also be Maximum Aluminium zeolite P (zeolite MAP) as described in European application EP 384 070. Zeolite MAP is defined as an alkali metal aluminosilicate of the zeolite P type having a silicon to aluminium ratio not exceeding 1.33, preferably not exceeding 1.15. Suitable aluminosilicate carrier materials have a unit cell formula [2] $Na_z[(AlO_2)_z(SiO_2)_y].xH_2O$ wherein z and y are at least 6; the molar ratio of z to y is from 1.2 to 0.5 and x is at least 5, preferably from 7.5 to 276, more preferably from 10 to 264. The aluminosilicate carrier material (ii) is preferably in hydrated form and is preferably crystalline, containing from 10% to 28%, more preferably from 18% to 22% by weight of water in bound form.

The preferred zeolite carrier material (alkali metal aluminosilicate) is present in an amount of from 40 to 90 wt % (based on its weight as anhydrous material). Preferably there will be at least 50 wt % and more preferably at least 55 wt % based on the weight of the particle. The granular material according to the invention may comprise no more than 90 wt %

Alternative, but less preferred aluminosilicates are clays. Typically, a clay could be or comprise a smectite clay. Preferred smectite clays are beidellite clays, hectorite clays, laponite clays, montmorillonite clays, nontonite clays, saponite clays and mixtures thereof. Preferably, the smectite clay is a dioctahedral smectite clay, more preferably a montmorillonite clay. Dioctrahedral smectite clays typically have one of the following two general formulae: [3] $Na_xAl_{2-x}Mg_xSi_4O_{10}(OH)_2$ or [4] $Ca_xAl_{2-x}Mg_xSi_4O_{10}(OH)_2$, wherein x is a number from 0.1 to 0.5, preferably from 0.2 to 0.4.

Preferred clays are low charge montmorillonite clays (also known as a sodium montmorillonite clay or Wyoming-type montmorillonite clay) which have a general formula corresponding to formula (I) above. Preferred clays are also high charge montmorillonite clays (also known as a calcium montmorillonite clay or Cheto-type montmorillonite clay) which have a general formula corresponding to formula (II) above. Examples of suitable clays include those supplied under tradenames: Fulasoft 1 by Arcillas Activadas Andinas; White Bentonite STP by Fordamin; Laundrosil ex 0242 by Sud Chemie; and Detercal P7 by Laviosa Chemica Mineraria SPA.

Alternatively suitable clays may also comprise a hectorite clay or a clay selected from the group consisting of: allophane clays, chlorite clays, preferably amesite clays, baileychlore clays, chamosite clays, clinochlore clays, cookeite clays, corundophite clays, daphnite clays, delessite clays, gonyerite clays, nimite clays, odinite clays, orthochamosite clays, pannantite clays, penninite clays, rhipidolite clays, sudoite clays and thuringite clays; illite clays; inter-stratified clays; iron oxyhydroxide clays, preferred iron oxyhydroxide clays are hematite clays, goethite clays, lepidocrite clays and ferrihydrite clays; kaolin clays, preferred kaolin clays are kaolinite clays, halloysite clays, dickite clays, nacrite clays and hisingerite clays; smectite clays; vermiculite clays; and mixtures thereof.

Preferably, clays used as aluminisilicate carrier materials have a weight average primary particle size, typically of greater than 10 micrometers, preferably more than 20 micrometers, more preferably from 20 micrometers to 40 micrometers. Clays having these preferred weight average primary particle sizes provide a further improved fabric-softening benefit and may therefore have a dual benefit in the textile treating process. The method for determining the weight average particle size of the clay is known in the art.

The binder materials for use in the granular materials according to the invention are materials which cause the granular materials according to the invention to be stable and easily handled without causing disintegration and which will also contribute to the ease of dispersion of the granular materials in the textile treating process for which they have been formulated. It is therefore necessary that the granular materials according to the invention also comprise a binder material. The binder material may be any of the known or proposed binder or encapsulant materials described for example in the art of protecting foam control agents in powder detergent compositions against deterioration upon storage. Suitable materials have been described in a number of patent specifications. G.B. 1 407 997 discloses the use of an organic material which is water soluble or water dispersible, substantially non-surface active and detergent impermeable.

Examples given in that specification include gelatine, agar and reaction products of tallow alcohol and ethylene oxide. In this patent specification the antifoam is protected in storage by causing the organic material to contain the antifoam in its interior, thus effectively isolating it. In G.B. 1 523 957 there is disclosed the use of a water insoluble wax having a melting point in the range from 55 to 100° C. and a water insoluble emulsifying agent. In E.P. 13 028 there is suggested that in combination with a carrier and a cellulosic ether, there is used a non-ionic surfactant, which is exemplified by ethoxylated aliphatic C12-20 alcohols with 4 to 20 oxyethylene groups, ethoxylated alkylphenols, fatty acids, amides of fatty acids, thio alcohols and diols, all having 4 to 20 carbon atoms in the hydrophobic part and 5 to 15 oxyethylene groups.

In E.P. 142 910, there is disclosed the use of a water soluble or water dispersible organic carrier comprising from 1 to 100% of a first organic carrier component having a melting point of from 38 to 90° C. and from 0 to 99% of a second organic carrier which is selected from ethoxylated non-ionic surfactants having a HLB of from 9.5 to 13.5 and a melting point from 5 to 36° C. Examples of the organic carrier materials include tallow alcohol ethoxylates, fatty acid esters and amides and polyvinylpyrrolidone. In E.P. 206 522 there is described the use of a material which is impervious to oily antifoam active substance when in the dry state, yet capable of disruption on contact with water. Examples given include materials with a waxy nature which may form an interrupted coating that will allow water to pass through under was conditions. Other materials which are listed include water soluble sugars. In E.P. 210 721 there is disclosed the use of an organic material which is a fatty acid or a fatty alcohol having a carbon chain of from 12 to 20 carbon atoms and a melting point of from 45 to 80° C., for example stearic acid or stearyl alcohol.

The binder material is included in the granular material according to the invention in an amount from 5 to 40 parts by weight based on the total weight of the granular material. More preferably the amount of binder material is used in amounts of from 10 to 30 parts, most preferably 10 to 25 parts by weight.

A particularly preferred binder is a polycarboxylate-type binder or encapsulant. An improved granular material may be obtained with such binder, which has better powder characteristics, has a better ability to disperse the granular material in use and a good storage stability. So-called polycarboxylate materials have been described in the art. Some of them have been suggested as polymeric coatings for example in E.P. 484 081, where they are used in conjunction with a silicone oil antifoam and a solid carrier which, though suggested as possibly being a zeolite, is preferably a carbonate.

Polycarboxylate materials are known and are water soluble polymers, copolymers or salts thereof. They have at least 60% by weight of segments with the general formula

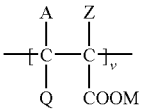

wherein A, Q and Z are each selected from the group consisting of hydrogen, methyl, carboxy, carboxymethyl, hydroxy and hydroxymethyl, M is hydrogen, alkali metal, ammonium or substituted ammonium and v is from 30 to 400. Preferably A is hydrogen or hydroxy, Q is hydrogen or carboxy and Z is hydrogen. Suitable polymeric polycarboxylates include polymerised products of unsaturated monomeric acids, e.g. acrylic acid, maleic acid, maleic anhydride, fumaric acid, itaconic acid, aconitic acid, mesaconic acid, citraconic acid and methylenemalonic acid. The copolymerisation with lesser amounts of monomeric materials comprising no carboxylic acid, e.g. vinylmethyl, vinylmethylethers, styrene and ethylene is not detrimental to the use of the polycarboxylates in the foam control agents of the present invention. Depending on the type of polycarboxylate this level can be kept low, or levels can be up to about 40% by weight of the total polymer or copolymer.

Particularly suitable polymeric polycarboxylates are polyacrylates with an average viscosity at 25° C. in mPa·s from 50 to 10,000, preferably 2,000 to 8,000. The most preferred polycarboxylate polymers are acrylate/maleate or acrylate/fumarate copolymers or their sodium salts. Molar mass of suitable polycarboxylates may be in the range from 1,000 to 500,000, preferably 3,000 to 100,000, most preferably 15,000 to 80,000. The ratio of acrylate to maleate or fumarate segments of from 30:1 to 2:1. Polycarboxylates may be supplied in powder form or liquid forms. They may be liquid at room temperature or may be supplied as aqueous solutions. The latter are preferred as they facilitate the manufacture of the foam control agents according to the invention with conventional spray applications. Many of the polycarboxylates are hygroscopic but are claimed not to absorb water from air when formulated in detergent powders.

Granular materials according to the invention may also comprise additional ingredients. It is particularly preferred that a surface active component is also included. Such surface active ingredient may be present in amounts which would result in a weight ratio of component (i) to the surface active agent of from 1:1 to 4:1. The presence of the surface active agent will facilitate the manufacturing process of the granular materials, which is described below in more detail.

Suitable surface active agents include organic surfactants. Organic surfactants which may be used in the invention may be any surface active material which does not con-tain any silicon atoms. It is preferred that the organic surfactant is soluble or dispersible in an aqueous medium. Suitable surfactants have been described in a number of publications and are generally well known in the art. It is preferred that the organic surfactant is able to emulsify a siloxane material at least to some extent in an aqueous system, more preferably the organic surfactant is a good emulsifier of a siloxane material, especially of siloxane materials which have at least one N-containing substituent.

Suitable organic surfactants for use in the present invention may be anionic, cationic, nonionic or amphoteric materials. Mixtures of one or more of these may also be used. Suitable anionic organic surfactants include alkali metal soaps of higher fatty acids, alkyl aryl sulphonates, for example sodium dodecyl benzene sulphonate, long chain (fatty) alcohol sulphates, olefin sulphates and sulpho-nates, sulphated monoglycerides, sulphated esters, sulphosuccinates, alkane sulphonates, phosphate esters, alkyl isothionates, sucrose esters and fluoro-surfactants. Suitable cationic organic surfactants include alkylamine salts, quaternary ammonium salts, sulphonium salts and phosphonium salts. Suitable nonionic surfactants include condensates of ethylene oxide with a long chain (fatty) alcohol or (fatty) acid, for example C14-15 alcohol, condensed with 7 moles of ethylene oxide (Dobanol® 45-7), condensates of ethylene oxide with an amine or an amide, condensation products of ethylene and propylene oxides, fatty acid alkylol amide and fatty amine oxides. Suitable amphoteric organic detergent surfactants include imidazoline compounds, alkylaminoacid salts and betaines. It is more preferred that the organic surfactants are nonionic or anionic materials, preferably with a HLB value of at least 7. Of particular interest are surfactants which are environmentally acceptable.

More preferred organic surfactants are alkyl sulphates, alkyl sulphonates, primary alkyl ethoxylates and alkylpolyglucosides or derivatives thereof. Many of these surfactants are commercially available. Specific examples of them are illustrated in the examples of the present specification. It is particularly useful to employ organic surfactants which have a melting point which is in the range of or higher than room temperature (i.e. 18° C.), as these surfactants will additionally improve the stability of the foam control agent during storage.

Alternative surface active agents may be organopolysiloxane polyoxyalkylene copolymer which are preferably water soluble or water dispersible copolymers. Suitable copolymers have been described in a number of publications and are generally known in the art. Suitable polyorganosiloxane polyoxyalkylene copolymers have a number of units X of the general formula $R^o_p$—Si—$O_{4-p}$ and at least one unit Y of the general formula $R^*R^+_q$—Si—$O_{3-q}$. $R^o$ denotes a monovalent hydrocarbon group having up to 24 carbon atoms, a hydrogen atom or a hydroxyl group. $R^+$ denotes an aliphatic or aromatic hydrocarbon group having up to 24 carbon atoms, preferably up to 18 carbon atoms. Suitable examples of $R^+$ include alkyl, aryl, alkaryl, aralkyl, alkenyl or alkynyl groups, for example methyl, ethyl, dodecyl, octadecyl, phenyl, vinyl, phenylethyl or propargyl. Preferably at least 60% or all $R^+$ groups are methyl or phenyl groups, more preferably at least 80%. It is most preferred that substantially all $R^+$ groups are methyl or phenyl groups, especially methyl groups. p and g independently have a value of 0, 1, 2 or 3. R* denotes a groups of the general formula A-$(OZ)_S$—B, wherein Z is a divalent alkylene unit having from 2 to 8 carbon atoms, A denotes a divalent hydrocarbon radical having from 2 to 6 carbon atoms, optionally interrupted by oxygen, B denotes a capping unit and s is an integer with a value of from 3 to 60. It is preferred that A is a divalent alkylene unit, preferably having 2 to 4 carbon atoms, e.g. dimethylene, propylene or isobutylene. Z is preferably a divalent alkylene unit having 2 or 3 units, e.g. dimethylene or isopropylene. B may be any of the known end-capping units of polyoxyalkylene groups, e.g. hydroxyl, alkoxy, aryloxy, acyl, sulphate, phosphate or mixtures thereof, most preferably hydroxyl, alkoxy or acyl.

Units X and Y may be the majority of units in the copolymer, but preferably they are the only units present in the copolymer. They may be linked to each other in a way to form random copolymers or block copolymers. The units Y may be distributed along the siloxane chain of the copolymer or they may be placed at one or both ends of such siloxane chain. Suitable copolymers will therefore have one of the following structures, wherein X' denotes one or more units X and Y' denotes one or more units Y: X'Y', Y'X'Y', X'Y'X', Y'$(X'Y')_e$, Y'$(X'Y')_e$X', X'$(Y'X')_e$ or any one of the above structure wherein one or more Y' groups have divalent polyoxyalkylene units which are linked at either end to a siloxane unit, thus forming a type of crosslinked polyorganosiloxane polyoxyalkylene unit. The value of e is not important, provided the copolymer satisfies the conditions of solubility or dispersibility laid down. Suitable copolymers have been described for example in Patent Specifications G.B. 1 023 209, G.B. 1 554 736, G.B. 2 113 236, G.B. 2 119 394, G.B. 2 166 750, G.B. 2 173 510, G.B. 2 175 000, E.P. 125 779, E.P. 212 787, E.P. 298 402 and E.P. 381 318.

It is preferred that the polyorganosiloxane polyoxy-alkylene copolymer has a substantially linear siloxane backbone, i.e. that the value of p is 2 and q is 1 for the majority of units present in the copolymer. This will result in a so-called ABA type polymer or in a rake type polymer. In the former units Y will be situated at each end of the siloxane chain, while in the latter units X and Y are dispersed along the siloxane chain, with the oxyalkylene units pending from the chain at certain intervals. More preferred are those copolymers

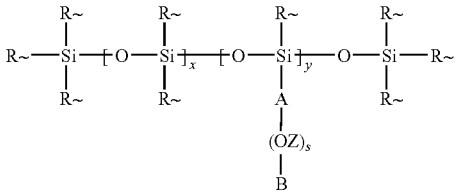

R~in these more preferred copolymers may denote any alkyl or aryl group having up to 18 carbon atoms, more preferably up to 6. Particularly preferred are methyl, ethyl or phenyl groups. Especially preferred are those copolymers wherein at least 80% of all R~ groups in the copolymer, most preferably substantially all R~ groups are methyl groups. A in these more preferred copolymers denotes a $C_{2-3}$ alkylene unit, most preferably propylene or isopropylene. Z preferably denotes a dimethylene group for at least half of all Z groups present in the copolymer, the other half being isopropylene groups. More preferably at least 70% of all Z groups are dimethylene groups, most preferably all Z groups, making the polyoxyalkylene portion a polyoxyethylene portion. B preferably denotes a hydroxyl group or an acyl group. The values of x and y may be any integer, preferably a value of from 1 to 500. x, y and s are chosen thus that the copolymer is either fully soluble or is dispersible in water or preferably in an aqueous surfactant solution. It is therefore preferred to balance the hydrophobic nature of the copolymer, which is determined to a large extent by the value of x, with the hydrophilic nature, which is deter-mined to a large extent by the value of y and s and by group Z. For example if the value of x is large, a long siloxane chain is formed which will make the copolymer less soluble and more dispersible in the aqueous surfactant solution of the washing liquor. This may be balanced by increasing the amount of units having oxyalkylene groups (value of y) and by the size of the polyoxyalkylene groups (value of s, especially where Z is dimethylene).

Particularly preferred polyorganosiloxane polyoxyalkylene copolymers will be those where the value of x+y is in the range of from 50 to 500, more preferably 80 to 350. The preferred ratio of y/x+y is from 0.02 to 0.1, more preferably 0.05 to 0.08. The value of s is preferably in the range from 4 to 60, more preferably 5 to 40, most preferably 7 to 36. A particularly useful copolymer is the one wherein x+y has a value of about 100 to 120, y/x+y has a value of about 0.09 and s has a value of 36, wherein half or the Z units are dimethylene units and half are isopropylene units.

Polyorganosiloxane polyoxyalkylene copolymers which are useful in granular materials according to the invention are known in the art, have been described in a number of patent specifications as described above, and many of them are commercially available. They may be made by a variety of methods, which have also been described or referenced in the above mentioned specifications. One particularly useful way of making suitable copolymers is by reaction of polyorganosiloxanes having silicon-bonded hydrogen atoms with appropriate allylglycols (allyl-polyoxyalkylene polymers) in the presence of a noble metal catalyst. A hydrosilylation reaction will ensure the addition reaction of the allyl group to the silicon atom to which the hydrogen atom was bonded.

Other useful additional components in the granular materials are enzymes, in particular cellulose enzymes, especially where they are intended for use in denim fading or stone washing processes. The amount of enzyme, if included in granular materials according to the invention, may range from traces to 15% by weight based on the total weight of the granular materials, preferably up to 10% by weight.

Preferably, there is at least 2 g of carrier component (ii) for 1 g of silicone material (i) in the granular material according to the invention. Thus, preferably, there is at least 2 parts by weight of component (ii) for one part by weight of component (i) in the granular material.

Granular materials according to the invention may be made by known processes, but are preferably made by forming an emulsion of the silicone material having at least one N-containing substituent using the binder material, water and preferably the optional surface active agent. The emulsion is then sprayed onto the aluminosilicates material and dried. It is thus preferred to make a premix of all components which are to be used, including optional ones (silicone having at least one N-containing substituent, binder material, optional surface active agent, optional enzyme and water), which may be done by any of the known methods, but is preferably done by emulsification, and to deposit the premix/emulsion onto the aluminosilicates material's surface. The premix can be made by simply mixing the ingredients, preferably with reasonable shear or high shear. Where one or more ingredients are solid or waxy materials, or materials of high viscosity, it may be beneficial to heat the mixture to melt or reduce the working viscosity of the mix, although if enzymes are included, care must be taken to ensure one does not exceed the temperature which the enzyme can tolerate before it becomes inactive. Alternatively the premix of the components may be diluted with a solvent, e.g. a low viscosity siloxane polymer, cyclic siloxane polymer, organic solvent or, as already indicated as the preferred method by making a dispersion/emulsion in water.

In accordance to a second aspect of the invention, there is provided a process for preparing granular material for use in the treating of textile materials, comprising (i) a silicone material having at least one nitrogen containing substituent, (ii) an aluminosilicate carrier and (iii) a binder, which comprises forming a water-in-oil emulsion of component (i) in conjunction with component (iii) by dispersing and agitating said components in water, followed by depositing said emulsion onto a free flowing powder form of component (ii) and removing sufficient water from the product to obtain a free flowing granular material.

Typical granule size will depend on the granulation process used, but may vary from as little as 50 microns to 5 millimeters. Sizes above 150 microns are preferred to ease flowability of the granular material, e.g. powder and to suppress potential dust formation during its use or handling. Typically the granule size will range from 200 and 1500 microns. The bulk density of the granular material will also vary depending on the process used, but also on the formulation used to make them. Typically the bulk density may vary from 300 and 1000 g/l. The granule formulation according to the invention will facilitate the dispersion of the silicone material having at least one nitrogen containing substituent when added to an aqueous process, such as the denim treatment. The granular material will disperse well particularly in neutral to slightly acidic aqueous environment, e.g. water, even at temperatures which range from room temperature up to 60° C. The granular material according to the invention will be stable upon storage.

Depositing the mix or emulsion onto the aluminosilicates carrier can be done in a number of ways. Conventional procedures of making powders are particularly useful for making the granular materials according to the invention. These include depositing of a previously prepared mixture/emulsion of all of the components onto the aluminosilicates carrier, which is the most preferred method. It is also possible to deposit each of the ingredients separately onto the zeolite. One particularly useful way of depositing the components onto the aluminosilicates carrier is by spraying one or more of these onto the carrier, which may be present in a drum mixer, fluidised bed etc. This may be done at room temperature or at elevated temperature, which is particularly useful if one wants to evaporate some or all of the solvent or water during the process. In one process the aluminosilicates carrier is mixed with the premix of all the other components, e.g. in a high shear mixer, e.g. Eirich® pan granulator, Schugi® mixer, Paxeson-Kelly® twin-core blender, Loedige® ploughshare mixer, Aeromatic® fluidised bed granulator or Pharma® type drum mixer. The deposition may be done by pouring the mixture into the mixer as well as spraying, as is described above.

The process of the invention uses from 5 to 25 parts by weight of silicone comprising at least one N-containing substituent and from 40 to 90 parts by weight of zeolite. If a lower amount of silicone were to be used this would make the granular material less effective, as the silicone would be too thinly distributed on the carrier material. Higher amounts than 25 parts of silicone are possible in theory but are not practical, as this would render the dispersion of the granular material in the textile treatment bath more difficult. Higher levels would also possibly result in a more tacky material, which would not be granulated very easily.

Granular materials according to the invention are useful for the treatment of textile materials. They are particularly useful in the treating of denim fabrics, as they aid the avoidance or limitation of backstaining, for example during the fading or stone washing process. According to a third aspect of the invention, there is provided a process of treating textile materials which comprises the use of granular material comprising (i) a silicone material having at least one nitrogen containing substituent, (ii) an aluminosilicate carrier and (iii) a binder by adding said granular material to an aqueous medium in which the textile materials are being treated. The granular material according to the invention may be used in conjunction with other treatment agents for the textiles, e.g. other granular materials such as granulated enzymes.

The process is particularly useful for denim materials. Denim is defined as a 3/1 warp-faced twill fabric made from cotton open-end yarn, dyed warp and undyed weft. Coarse yarns are used to construct both the warp and weft face in denim. However, denim weaves can be coarse (3/1), broken twill (3/1, staggered), fine (2/1) or chambray (1/1). Denim is made by weaving dyed yarns (called warp yarns) with undyed or filling yarns. Indigo, sulphur and indanthrene are mainly used in the dyeing process. Indigo dye is the most popular choice as it has good depth of shade and suitable rubbing and washing fastness. When cotton yarn is dyed with indigo, it leaves a ring-dyeing effect, because of which the outer layer of warp yarn is coated with indigo, and the core of the yarn remains undyed. This gives the denim garment a unique 'faded look' and a rich blue shade after repeated use and wash.

Denim fabric is normally finished after the weaving process and is mostly processed in the garment stage. Denim finishing involves the steps of brushing to remove lint, fluffs and loose impurities, singeing to burn away the protruding fibres from the surface, which otherwise impart a fuzzy look to the fabric, chemical application of materials which impart softness and the like, stretching and skewing to avoid deformation and twisting e.g. in the jeans legs made out of such fabric, predrying, compressive shrinking to ensure that the finished fabric doesn't show high shrinkage after subsequent washes, surface abrading, which may take the form of emerizing or sueding to result in soft and fluffy flannel effect, which makes the fabric extremely pleasant to the wearer and final.

Denim washing includes the common steps of desizing or preparation, fading or stone washing, post treatment & finishing. The purpose of desizing is to remove the size, which was applied on indigo dyed warp prior to weaving and to prepare the garments for subsequent processes, like enzyme wash. It is done by treating the garments in a washing machine with α-amylase enzymes or with a non-enzymatic desizer. In this process, many of the long cellulose chains of cotton are broken down into smaller chains by cellulose enzymes and these smaller chains are either dissolved or dispersed in the wash liquor. Along with the cellulose parts, indigo dyes also leave the fabric, giving the garment a stone-washed effect. Acid enzymes give better fading effect than neutral enzymes. But a general consequence of acid enzymes is the back staining, which is due to the optimum pH at which they operate. Back staining is the re-deposition of dislodged indigo dye on the garments. Among other effects, it hinders the development of a desired blue-white contrast. Neutral enzymes lead to less back staining on garments, but they induce less fading, when compared to acid enzymes.

The process of treating the textile materials in the denim process according to the invention is particularly useful during the fading step. However, even when applied later in the denim process, benefits are obtained by the use of the granular material, including softening. Addition during the fading step is particularly useful as the delivery under the granular form is increasing the compatibility of the silicone material having at least one nitrogen-containing substituent with the enzymes used during the fading step. These enzymes can be neutral or acidic types of enzymes. Alternatively the granule can also be added with the pumice stones if this way is used to provide fading to the denim. If a bleaching step is to be applied to the denim during the finishing treatment, then it is preferred that the addition of the granule is done after the bleaching step to provide optimum softening performance. Accordingly the invention provides a process for treating denim in a fading step of their processing by using the granular materials according to this invention and dispersing them into the aqueous environment in which the denim materials are treated to effect fading.

The use of the granular materials according to the invention will enable greater process flexibility for the textile manufacturer in particular for the denim finishing manufacturer. The granular material will deliver the typical silicone-related softening properties during the process at any time, without inducing any detrimental effect on other aspects of textile treatment or finishing, in particular on fading of denim, which the use of conventional silicone emulsion would not be able to provide. In particular, however, the granular material, while maintaining good fading properties if added during the enzymatic bath or pumice stones bath, will help in preventing the redeposition of for example the indigo dyes on fabric, thus reducing the back staining and increasing the contrast between white cotton and denim, between faded and unfaded parts of a garment. These benefits can additionally result in reducing the need for rinsing the textiles during its treatment process, particularly during the denim treatment process. Additionally, it has been found that the delivery of a silicone via the use of granular materials decreases the risk of potential spotting by the silicone on fabrics, as is often seen in the textile industry when using traditional silicone materials having at least one nitrogen-containing substituent in emulsion form, especially in high shear processes for textile treatment, of which denim treatment and bio-polishing treatment are examples.

EXAMPLES

The following examples are given to illustrate the invention and are not limitative. All parts and percentages are given by weight, unless specifically stated otherwise.

Example 1

Preparation of a granular material containing a silicone having at least one nitrogen containing substituent:

A silicone containing granule according to the invention was prepared by mixing approximately 45 parts of the a zeolite Doucil® A24, a zeolite manufactured by Ineos, with approximately 30 parts of Sokalan® PA 25 PN polyacrylic polymer material provided by BASF, approximately 10 parts of a substantially linear siloxane material having at least one N-containing substituent having a viscosity of 1500 $mm^2/s$ and containing 0.4% in weight of nitrogen under the form of mono amine groups, approximately 10 parts of a nonionic surfactant Volpo® T7/85 provided by Croda, and approximately 5 parts of water. The mixture was prepared by purely mechanically mixing the silicone, the surfactant, the water and the polymer together and pouring the mixture very slowly into a drum mixer which contained the zeolite. This mixture was stirred continuously until a particulate material was obtained. Water which was contained in the granular material was removed in a fluidized bed using hot air at 60° C. The resulting granules were off-white and free-flowing, had a mean particle size of 400 microns and a bulk density of 532.

Example 2

A granular material according to the invention was prepared as described in the Example 1, except that zeolite 4A from Ineos was used instead of the Doucil® A24. The resulting granule was off-white and free-flowing having a mean particle size of 530 microns and a bulk density of 700.

Example 3 (Comparative)

An emulsion containing a silicone material having at least one nitrogen-containing substituent was prepared as described in Example 1 except that the mixture was not poured onto a powder material. The viscosity of the obtained emulsion is 250 $mm^2/s$.

Example 4 (Comparative)

A granular material was prepared as described in the Example 1, except that instead of a zeolite, native maize starch supplied by Cerestar was used. The resulting granule was white to yellow and free-flowing, having a mean particle size of 610 microns and a bulk density of 740.

Example 5

The samples prepared as described in the Examples 1 and 3 were in evaluated in denim finishing application. A denim treatment washing machine has been used to perform the evaluation. 5 leg panels (made of stitch denim and stitch white cloth) of a total weight of 150 g were used in the test with a volume liquor of 12 liters. 2 different sets of treatment conditions have been applied to the leg panel to get the desired finishing, of which the details are given below.

A first set of treatment conditions—called 'simplified process' consisted of:

Step 1: desizing step using 1 g/l of Ezy Size® 3xxd supplied by Resil, the enzyme was added at 60° C. for 30 minutes at pH6.5

Step 2: Draining and washing step using cold grounded water for twice 5 minutes at pH 7-8

Step 3: Fading and softening step using 1 g/l Ezyfade G+ supplied by Resil for 45 minutes at pH 4.5 and 55° C., followed by the addition of 1 g/l of granule or 0.5 g/l of emulsion (equivalent dosage of silicone) for 20 minutes at 55° C. at pH 4.5.

Step 4: Drain, hydro extract and drying for 15 to 20 minutes at 80-90° C.

The softening step was combined on purpose with the fading step. This softening step is usually performed as the step 5, just before the final drying step.

A second set of treatment conditions—called 'full process' consisted of:

Step 1: desizing step using 1 g/l of Ezy Size® 3xxd supplied by Resil, the enzyme was added at 60° C. for 30 minutes at pH6.5

Step 2: Draining and washing step using cold grounded water for twice 5 minutes at pH 7-8

Step 3: Fading step using 1 g/l Ezyfade G+ supplied by Resil for 45 minutes at pH 4.5 and 55° C., Step 4: Draining and washing step using cold grounded water for twice 5 minutes at pH 7-8

Step 5: addition of 1 g/l of granule or 0.5 g/l of emulsion (equivalent dosage of silicone) for 20 minutes at 55° C. at pH 4.5.

Step 6: Drain, hydro extract and drying for 15 to 20 minutes at 80-90° C.

The fading and backstaining were evaluated by people skilled in the art by visual inspection. The results are described here below:

Example 3 (comparative) was evaluated in the 'simplified' and the 'full' process. It was found that denim fabric treated with Example 3 using the 'simplified process' showed significant poorer fading and significant more back staining than when using the 'full' process.

When Examples 1 and 3 were evaluated in the 'full' process, the denim fabric treated with Example 1 using the 'full' process showed significant improved fading but similar back staining compared with denim fabric treated with Example 3 using the 'full' process.

The samples prepared as described in the Examples 2 and 4 (comparative) were evaluated in Denim finishing application. A denim treatment washing machine was used to perform the evaluation. 9 trouser garments of a total weight of 7400 g were used by test with a volume liquor of 148 liters. The following steps have been performed on raw Denims to get the desired finishing.

Step 1: desizing step using 1 g/l of Ezy Size® 3xx1 supplied by Resil, the enzyme is added at 60° C. for 30 minutes at pH 6.5

Step 2: Draining and washing step using cold grounded water for twice 5 minutes at pH 7-8

Step 3: Fading and softening step using 1 g/l of Neutrafade® EXL 200G supplied by Resil for 45 minutes at pH 6.5 and 55° C., followed by the addition of 1.5 g/l of granule for 20 minutes at 55° C. at pH 6.5.

Step 4: Drain, hydroextract and drying for 15 to 20 minutes at 80-90° C.

The softening step has been combined on purpose with the fading step. This softening step is usually performed as the step 4, just before the final drying step.

The handling, fading and backstaining were rated by people skilled in the art by sensory and visual inspection. The handling is rated on a scale from 1 to 9 with 1 being low and 9 being excellent. The fading is rated from 0 to 5, with 0 being poor and 5 being good. The backstaining is rated from 1 to 9 with 1 being a lot of back staining (undesirable) and 9 showing no back staining. The results can be found in the Table 1:

TABLE 1

| | Handling | Fading | backstaining |
|---|---|---|---|
| Example 2 | 5.5 | 5 | 6 |
| Example 4 | 6 | 3.5 | 3 |

From the results it can be seen that the silicone material having at least one nitrogen containing substituent when delivered in granular form according to the invention is bringing softening/handling benefits when added during the denim treatment process. Moreover the addition of the silicone material having at least one nitrogen containing substituent when delivered in granular form is enabling better fading and backstaining properties during the process in comparison to a liquid delivery, even when added during the fading step.

Examples 6 to 9

The granulation process can be applied using various silicone materials having at least one nitrogen containing substituent. The silicone bonded nitrogen-containing substituent will directly impact the softening/handling benefits delivered by the granule. Granules were prepared using the following procedure:

42 parts of the a zeolite Doucil® A24, a zeolite manufactured by Imps, were mixed with approximately 15 parts of Sokalan® PA 25 PN polyacrylic polymer material provided by BASF, approximately 18 parts of a silicone material as described below, approximately 3 parts of nonionic surfactant Tergitol® TMN10 and 2 parts of nonionic surfactant Tergitol® 15-S-7 provided by Dow, and approximately 20 parts of water. The mixture was prepared by purely mechanically mixing the silicone, the surfactant, the water and the polymer together and pouring the mixture very slowly into a drum mixer where the zeolite was already present. The mixture was stirred continuously until a particulate material was obtained. The water contained in the granular material was removed in a fluidized bed using hot air at 60° C.

Different silicone materials having at least one N-containing substituent were used as described below:

Example 6: granule containing a silicone polymer having a viscosity of 5000 $mm^2/s$ having 0.65% in weight of nitrogen group under the form of amido groups.

Example 7: granule containing a silicone polymer having a viscosity of 8000 $mm^2/s$ having 0.36% in weight of nitrogen group under the form of amido groups.

Example 8: granule containing a silicone polymer having a viscosity of 1500 $mm^2/s$ having 0.37% in weight of nitrogen group under the form of amino groups.

Example 9: granule containing a silicone polymer having a viscosity of 3000 $mm^2/s$ having 0.36% in weight of nitrogen group under the form of di-amino groups.

The softening/handling performance of the above granules was evaluated on denim using an exhaustion test consisting of adding 2% of weight of silicone contained in the granule per weight of fabric in a beaker containing water and a 10 g denim piece of fabric. The handling was rated between 1(poor handling) to 9 (good handling) by people skilled in the art by sensory inspection. The results can be found in Table 2.

TABLE 2

| | Handling |
|---|---|
| Example 6 | 5 |
| Example 7 | 6.5 |
| Example 8 | 7 |
| Example 9 | 4 |

Example 10

An alternative carrier was used for the granulation as described in the example 9. 64 parts of the a bentonite QPC 200, a clay manufactured by Colin Stewart, were mixed with approximately 10 parts of Sokalan® PA 25 PN polyacrylic polymer material provided by BASF, approximately 11 parts of a silicone polymer having a viscosity of 3000 $mm^2/s$ having 0.36% in weight of nitrogen group under the form of di-amino groups, approximately 3 parts of nonionic surfactant Tergitol® TMN10 and 2 parts of nonionic surfactant Tergitol® 15-S-7 provided by Dow, and approximately 10 parts of water. The mixture was prepared by purely mechanically mixing the silicone, the surfactant, the water and the polymer together and pouring the mixture very slowly into a drum mixer in which the clay had been placed. The mixture was stirred continuously until a particulate material was obtained. The water contained in the granular material was removed in a fluidized bed using hot air at 60° C.

The invention claimed is:

1. A process for finishing denim materials comprising preparing granular material comprising (i) a silicone material having at least one nitrogen containing substituent, (ii) at least 40% by weight of an aluminosilicate carrier, and (iii) a binder which is a film forming polymer and is a polyacrylic acid, said process comprising preparing the granular material comprising forming a water-in-oil emulsion of component (i) in conjunction with component (iii) by dispersing and agitating the components in water, followed by depositing the emulsion onto a free flowing powder form of component (ii), and removing sufficient water from the product to obtain a free flowing granular material; and using the granular material in the finishing of denim materials.

2. A process according to claim 1, wherein the emulsion formed also comprises a surface active material.

3. A process according to claim 1, wherein the emulsion is sprayed onto the aluminosilicate carrier using equipment capable of effecting agglomeration.

4. A process of finishing denim materials which comprises the use of a granular material by adding the granular material to an aqueous medium in which the denim materials are being finished, wherein the granular material comprises (i) a silicone material having at least one nitrogen containing substituent, (ii) at least 40% by weight of an aluminosilicate carrier, and (iii) a binder which is a film forming polymer and is a polyacrylic acid.

5. A process according to claim 4, wherein the granular material is added into the finishing steps of denim.

6. A process of minimising the backstaining of denim during a fading process by using in the fading process a granular material comprising (i) a silicone material having at least one nitrogen containing substituent, (ii) at least 40% by weight of an aluminosilicate carrier, and (iii) a binder which is a film forming polymer and is a polyacrylic acid.

7. A process according to claim 1, wherein the granular material comprises from 5 to 25% by weight of component (i), from 40 to 90% by weight of component (ii), and from 5 to 40% by weight of component (iii).

8. A process according to claim 7, wherein, in the granular material, the silicone material (i) is selected from an amino-functional siloxane, amido-functional siloxane, imide-functional siloxane, and ammonium-functional siloxane.

9. A process according to claim 1, wherein, in the granular material, the silicone material (i) is selected from the group consisting of an amino-functional siloxane, amido-functional siloxane, imide-functional siloxane, and ammonium-functional siloxane.

10. A process according to claim 1, wherein, in the granular material, the aluminosilicate carrier is a zeolite.

11. A process according to claim 1 , wherein the granular material also comprises a surface active material and/or an enzyme.

12. A process according to claim 1, wherein, in the granular material, there is at least 2 parts by weight of component (ii) for one part by weight of component (i).

13. A process according to claim 1, wherein, in the granular material, component (i) is present in an amount of from 10 to 20 parts, component (ii) from 50 to 70 parts, component (iii) from 5 to 25, a surface active material in an amount from 0 to 10 parts, and an enzyme in an amount of from 0 to 15 parts by weight.

* * * * *